United States Patent [19]

Watson

[11] 4,185,779

[45] Jan. 29, 1980

[54] FUEL INJECTOR

[75] Inventor: Edwin B. Watson, Sidney, N.Y.

[73] Assignee: The Bendix Corporation, Southfield, Mich.

[21] Appl. No.: 869,875

[22] Filed: Jan. 16, 1978

[51] Int. Cl.[2] ..... F02M 51/00

[52] U.S. Cl. ..... 239/533.3; 123/32 EA; 123/139 E

[58] Field of Search ..... 239/533.3, 585, 88, 239/96; 123/32 AE, 32 EA, 32 AB, 32 E, 139 AK, 139 E, 139 AH

[56] References Cited

U.S. PATENT DOCUMENTS

| | | | |
|---|---|---|---|
| 3,837,324 | 9/1974 | Links | 123/32 AE |
| 4,129,254 | 12/1978 | Bader, Jr. et al. | 123/139 E |

*Primary Examiner*—James B. Marbert

*Attorney, Agent, or Firm*—Gaylord P. Haas, Jr.; Russel C. Wells

[57] ABSTRACT

A fuel injector, especially adapted for diesel engines, is disclosed in which injection timing and fuel metering may be controlled from cycle to cycle of engine operation. Means are provided to control the timing of the injection independently of the metering of the fuel quantity for the injection cycle. The injector comprises an injector pump and timing valve means, including a solenoid valve and a shuttle valve, which controls the energization of the pump to execute an injection stroke. It also comprises metering valve means, including a solenoid valve and a shuttle valve, which controls the return stroke of the injector pump to meter the fuel quantity to be injected on the injection cycle.

15 Claims, 9 Drawing Figures

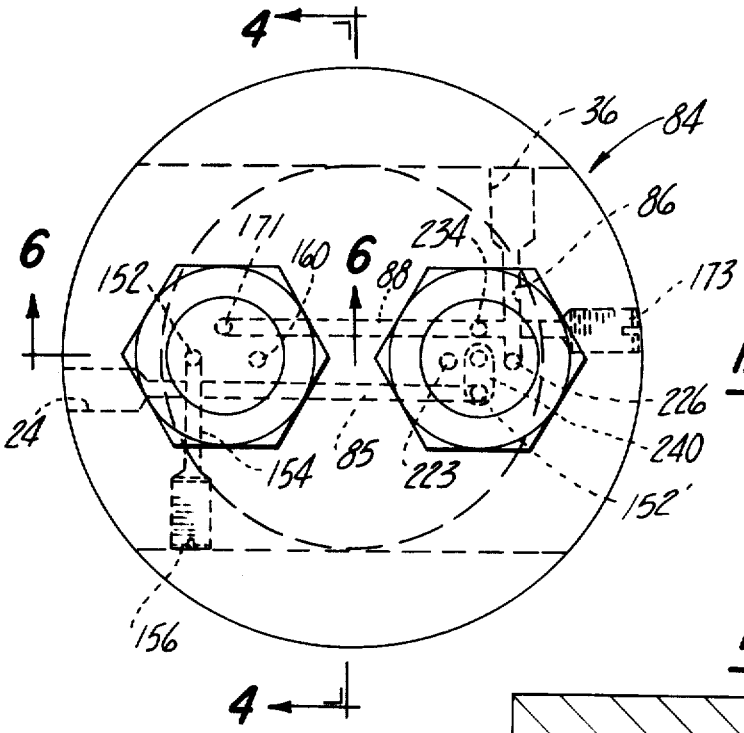
Fig-3
Fig-4
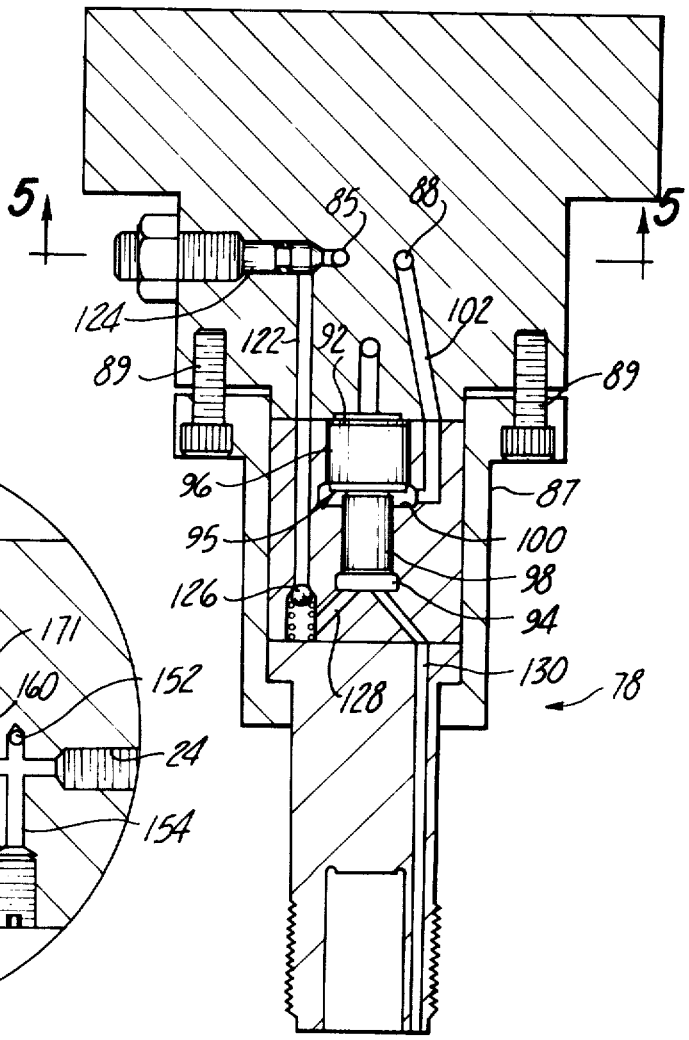
Fig-5
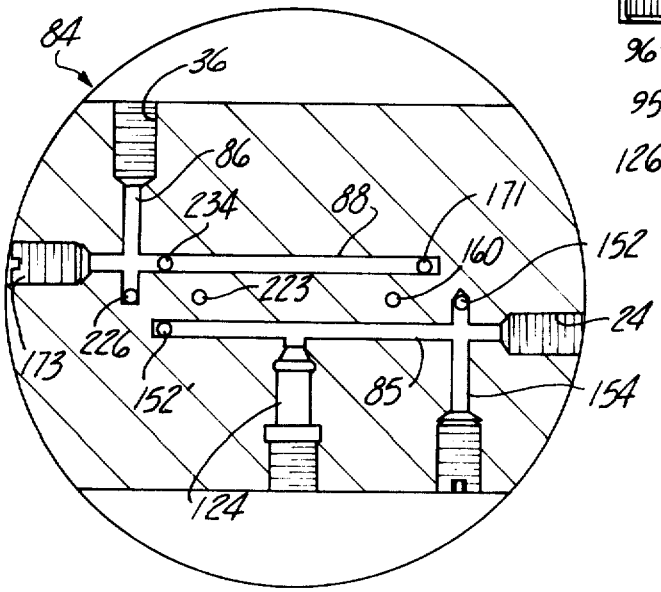

FUEL INJECTOR

TECHNICAL FIELD

This invention relates to fuel injection systems for internal combustion engines and more particularly it relates to an improved injector. The improved injector is adapted for precise timing and metering of the fuel injection by electronic control signals governed by engine operating conditions.

BACKGROUND ART

In the operation of internal combustion engines with fuel injection, especially diesel engines, both the timing and the quantity of fuel injection are important in obtaining the desired performance. In some engines it is necessary to inject large quantities of fuel at high pressure. Further, the operating parameters which determine the optimum timing for injection may vary independently of those parameters which determine the optimum quantity of fuel with such variations occurring from one engine cycle to the next. It is presently known to utilize an electronic computer to develop control signals for injection timing and metering which can be changed from one engine cycle to the next in accordance with engine operating parameters, such as speed setting, manifold vacuum, atmospheric pressure and the like.

In the prior art, it has been proposed to provide a fuel injector in which the timing of the injection is controlled independently of the fuel quantity of the injection. Such an arrangement is shown in the Bassot et al U.S. Pat. No. 3,516,395. In the injector of this patent an electromagnetic valve is opened for a controlled time period to admit fuel under constant pressure to a metering chamber for injection. The timing of the initiation of injection is controlled by an engine operated 3-way valve which admits fluid pressure to the servo cylinder to actuate the injection piston. In the Hussey et al Pat. No. 3,587,547 the timing and metering of the injection are controlled separately, the metering being performed by opening a fuel distributing valve for a controlled time period. It has also been proposed to control the metering of fuel for each injection by controlling the length of the injection stroke of the injector piston by controlling the quantity of the actuating fluid for the piston. This is described in the Sampietro U.S. Pat. No. 2,946,513.

Fuel injectors utilizing an electromagnet for controlling the timing and metering of the fuel injection are well known in the prior art. The Komaroff U.S. Pat. No. 3,623,460 discloses an injector in which the injector piston is actuated directly by an electromagnet on both the forward and reverse strokes. On the reverse stroke, the fuel is metered by the amount of time that the piston is retracted from the neutral position and injection is initiated by the forward stroke. In the injector of the Links U.S. Pat. No. 3,835,829 a single solenoid valve controls the metering and the timing of the fuel injection. When the solenoid is de-energized fuel flows into the pump chamber and when it is energized the fuel pressure energizes the servo piston and causes injection to occur. In the injectors described in these patents, the metering depends upon the length of the time period and the value of the supply pressure during which fuel flows into the metering chamber. Solenoid controlled injectors are also show in the Monpetit et al U.S. Pat. No. 3,680,782 and the Reneault et al U.S. Pat. No. 3,802,626.

It is known to provide an injector with a spool valve for controlling the energization of the servo piston and to employ a pilot valve to control the spool valve, as shown in Takahashi et al U.S. Pat. No. 3,943,901. In the injector of this patent a single pilot valve, either a monostable or a bistable fluid element, energizes the servo piston through the pilot valve when it is in one position and it actuates the spool valve to deenergize the servo piston when the pilot valve is in the other position. The timing and the quantity of fuel injection both depend upon the duration of the control signal on the pilot valve.

An objective of the present invention is to provide an injector which overcomes certain disadvantages of the prior art, especially in respect to the manner and precision with which timing and metering is executed for each injection of fuel.

DISCLOSURE OF THE INVENTION

In accordance with this invention, a fuel injector is provided which is adapted for electronic control of timing and metering of the fuel injection; in particular with the timing of the injection being controlled independently of the metering of the fuel quantity. This is accomplished by using a separate timing valve means and metering valve means for controlling the energization of the injection pump. A timing signal is effective to initiate the injection stroke and, after injection is completed, a metering signal is effective to control the quantity of fluid supplied for the next injection cycle.

Further, in accordance with this invention, metering of the fuel quantity for each injection is achieved by controlling the volume of the metering chamber. This is accomplished by controlling the length of the return stoke of the injection piston in the metering chamber and filling the chamber with fuel in preparation for the next injection cycle.

Additionally, in accordance with the invention, there is provided an injector which has a short response time and is capable of delivering fuel to the nozzle at high pressure and large volume. This is accomplished by using a timing valve means, including an electromagnetic pilot valve and a shuttle valve, to control the energization of an injection pump to produce the injection stroke of the pump. A metering valve means, including an electromagnetic pilot valve and a shuttle valve, is used to control the return stroke of the pump and allow the metering chamber to be filled to a controlled volume. The injector pump preferably comprises an actuator piston of larger effective area than that of the injector piston to obtain a desired pressure amplification to produce high pressure at the nozzle for injection.

A more complete understanding of this invention may be obtained from the detailed description that follows taken with the accompanying drawings.

BRIEF DESCRIPTION OF DRAWINGS

FIG. 3 shows the fuel injector in plan view;

FIG. 4 is a view taken on lines 4—4 of FIG. 3;

FIG. 5 is a view taken on lines 5—5 of FIG. 4;

BEST MODE FOR CARRYING OUT THE INVENTION

Figure 1:
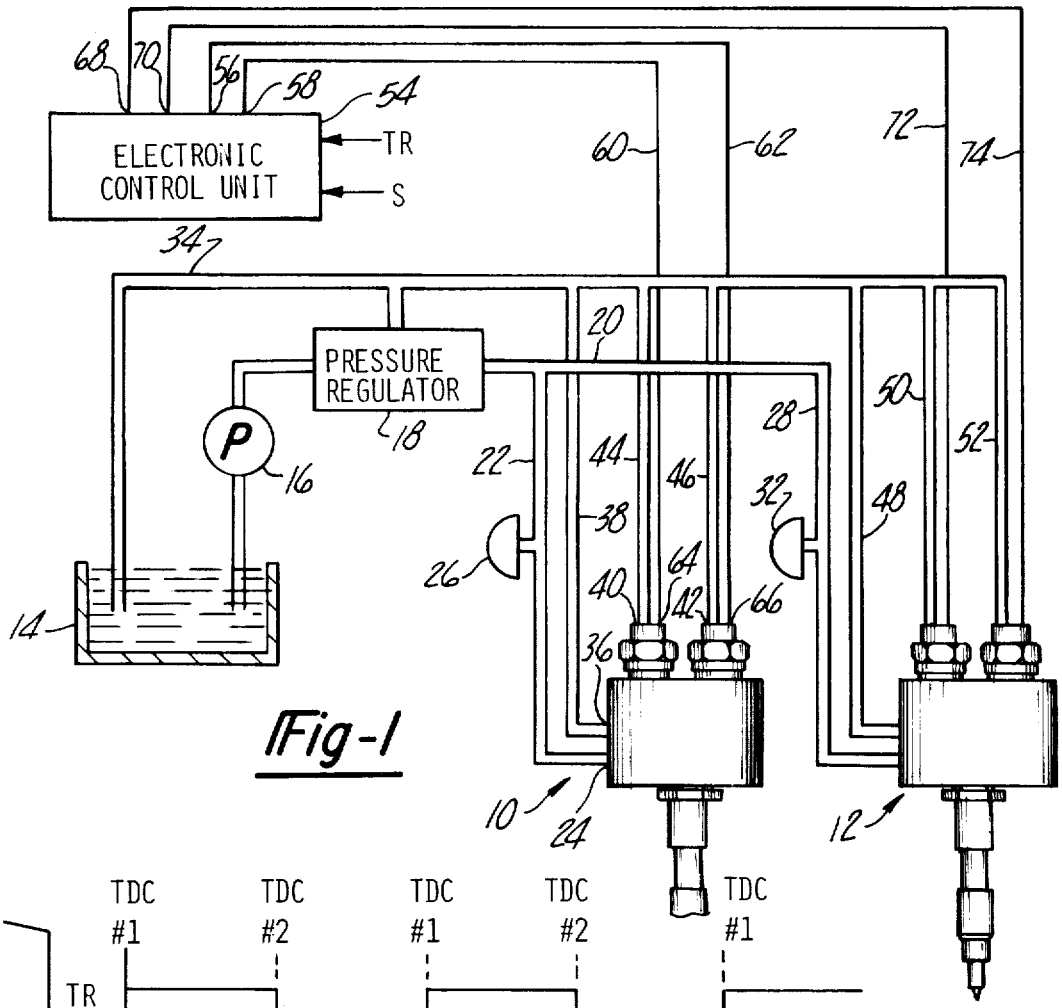
FIG. 1 is a diagram of a fuel injection system embodying the present invention.

Referring now to the drawings, there is shown an illustrative embodiment of the invention in a fuel injector especially adapted for use with a diesel engine. The injector is of unitary construction and adapted to be mounted in the cylinder head of the engine. It is adapted to be connected with a remote fuel supply source and drain and is responsive to electrical control signals from a remote electronic control unit.

The Injector in a Typical System

Referring now to FIG. 1, the illustrative embodiment of the invention is shown in a fuel injection system for a two-cylinder diesel engine. The system comprises an injector 10 for one cylinder of the engine and an identical injector 12 for the other cylinder of the engine. A fuel supply source including a tank 14 is adapted to deliver fuel under pressure to the injectors. The source comprises a pump 16 having an inlet conduit connected with the tank 14 and an outlet conduit connected to a pressure regulator 18. The regulated output of the pressure regulator 18 is supplied over a common rail or conduit 20 to the injectors. A branch supply conduit 22 is connected with a fuel supply inlet 24 of injector 10. An accumulator 26 is suitably connected with the branch supply conduit 22. Similarly, a branch supply conduit 28 extends from the common conduit 20 to a fuel supply inlet 30 of injector 12 and is provided with an accumulator 32. The fuel system further comprises a common drain conduit 34 connected with the tank 14. The injector 10 has a first drain outlet 36 connected through a branch drain conduit 38 to the common conduit 34; it also has second and third drain outlets 40 and 42 connected with the common drain conduit 34 through branch drain conduits 44 and 46, respectively. In similar manner, the injector 12 is connected with branch drain conduits 48, 50 and 52.

The fuel injection system, as shown in FIG. 1, also comprises an electronic control unit 54 which is adapted to provide control signals to the individual injectors 10 and 12 in accordance with engine operating conditions. In order to provide proper timed relation or phasing of the control unit 54 with the engine, a trigger signal generator (not shown) is driven in synchronism with the engine and produces a trigger signal TR which is applied to the control unit 54. The trigger signal is suitably of rectangular waveform having the leading edge of a rising pulse occur at top dead center of the piston in the first cylinder and having a leading edge of a falling pulse occur at top dead center of the piston in the second cylinder. The electronic control unit is also adapted to receive data signals indicative of instantaneous values of engine operating parameters from one or more suitable transducers for the purpose of computing the optimum timing, i.e. injection advance, and the quantity of each fuel injection. A throttle signal S, indicative of the desired engine speed, is representative of such data signals and is applied to the control unit 54 as indicated in FIG. 1.

The electronic control unit 54 also comprises a pair of output terminals or ports 56 and 58 which are electrically connected by conductors 60 and 62 to respective input terminals or ports 64 and 66 on injector 10. The electronic control unit also comprises a pair of output ports 68 and 70 which are connected respectively over conductors 72 and 74 with respective input ports on injector 12. The injectors 10 and 12, as stated above, are identical to each other; the injector 10 will now be described in detail.

General Arrangement of the Fuel Injector

In general, as shown in FIGS. 2 through 8, the injector comprises an injector nozzle 76 and an injector pump 78 which supplies fuel at a desired injection pressure to the nozzle. The injector pump 78 is controlled by timing valve means 80 and by metering valve means 82 to cause the injection of a predetermined metered quantity of fuel at a pedetermined time during each engine cycle.

The fuel injector comprises a housing or body member 84 which supports the timing valve means 80 and the metering valve means 82 and also provides for connection of a fuel supply source and drain. The body member 84 comprises an upper body portion of circular cross-section and a lower body portion having flat front and rear faces. The fuel supply inlet 24 is provided on the body member 84 and a fuel supply passage 85 (see FIGS. 3, 4 and 5) extends transversely in the body member. Also, the first fuel drain outlet 36 and interconnected drain passages 86 and 88 are provided in the body member.

Figure 2:
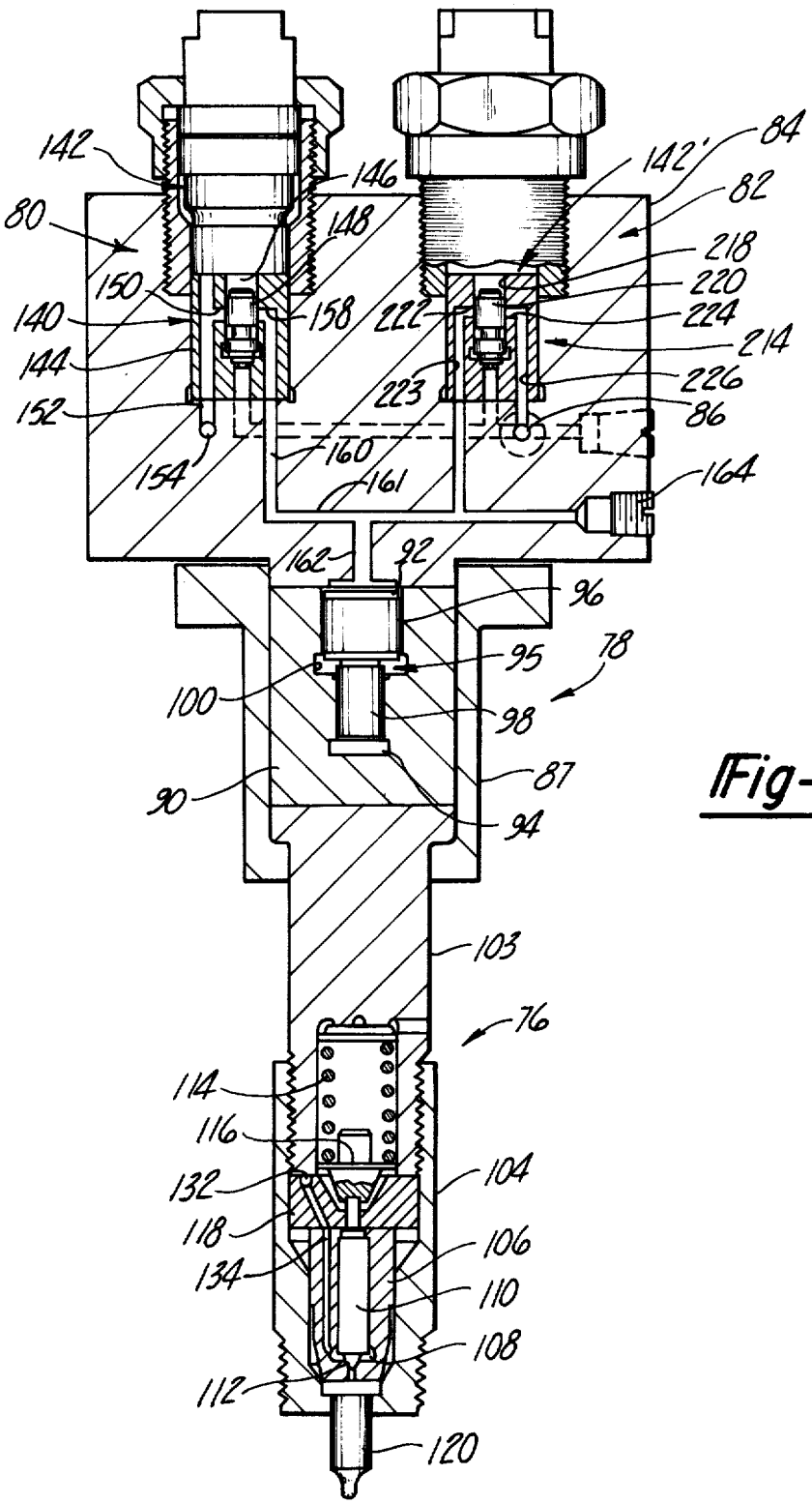
FIG. 2 shows the fuel injector of this invention in cross-section through its longitudinal axis.

As shown in FIG. 2, the injector pump 78 is mounted on the body member 84 and the injector nozzle 76 depends from the pump 78. The pump 78 and the nozzle 76 are secured to the body member 84 by a flange member 87 which is held to the body member 84 by a pair of threaded fasteners 89.

The injector pump 78 will now be described in detail with reference to FIGS. 2 and 4. The injector pump 78 comprises a pump body 90 which defines an actuator chamber 92 and the metering chamber 94. The pump is fitted with a pmup piston 95 including an actuator piston 96 in the actuator chamber and an injector piston 98 in the metering chamber. The actuator piston is of substantially larger diameter than the injector piston and hence energization of the pump by admitting fuel supply pressure into the actuator chamber 92 produces an amplified fluid pressure in the metering chamber 94. The amplification ratio is selected so that the fluid pressure in the metering chamber is equal to or greater than the required injection pressure, i.e. the value required to actuate the injector nozzle. The actuator piston and the injector piston are connected together, suitably as an integral structure. An enlarged annular chamber 100 between the actuator chamber and the metering chamber is connected through a passage 102 to the transverse drain passage 88 and thence through the passage 86 to the drain outlet 36. The actuator piston of the pump is energized by timing valve means 80 to produce a forward stroke of the injector piston 98 in the metering chamber and is controlled by the metering valve means 82 to produce a return stroke of the injector piston. The metering chamber 94 is connected to the fuel supply source and to the nozzle as described below.

The nozzle 76 is of known construction and is connected with the pump 78 by the flange member 87. The nozzle comprises a holder body 103 having a head portion retained by the flange member 87 and also comprises a holder nut 104 which is threaded onto the lower end of the holder body 103. The lower end of the holder nut 104 is provided with threads for screwing the injector into the cylinder head of the engine. The nozzle 76 includes a nozzle body 106 which is retained within the holder nut and is provided with an annular chamber 108 communicating with an axially extending nozzle outlet passage. A needle valve 110 in the nozzle body is adapted to engage a valve seat 112 to open and close communication between the chamber 108 and the nozzle outlet passage. The needle valve 110 is biased toward the closed position by a helical spring 114 seated within the holder body 103. An adaptor 116 is disposed between the lower end of the spring and the upper end of the needle valve 110. A stop plate 118 is disposed between the upper end of the nozzle body 106 and the lower end of the holder body 103. A stem on the needle valve 110 extends through the stop plate into engagement with the adaptor 116. A spray tip 120 is connected with the nozzle body 106 and held in assembled relation therewith by the holder nut 104. The spray tip is in fluid communication with the outlet passage of the nozzle body and is adapted to deliver fuel in a fine mist to the combustion chamber of the engine.

For the purpose of supplying fuel to the nozzle, an axially extending fuel supply passage 122 is in fluid communication with the fuel pressure supply passage 85. This is suitably provided through a calibrating orifice which is adjustably set by a calibrating needle 124 (see FIG. 4). A check valve 126 has its inlet in communication with the passage 122 and its outlet connected through a passage 128 to the fuel metering chamber 94 in the pump 78. The metering chamber is connected through a nozzle supply passage 130 in the pump body and in the holder body to an annular passage 132 (see FIG. 2) in the upper surface of the stop plate 118. The annular passage 132 communicates with a passage 134 which extends through the stop plate 118 and through the nozzle body 106 to the annular chamber 108. It will be understood as the description proceeds that fuel under pressure from the fuel supply source is delivered from the supply passage 85 to the metering chamber 94 and thence to the nozzle in readiness for injection into the engine cylinder.

The Timing Valve Means

Figure 6:
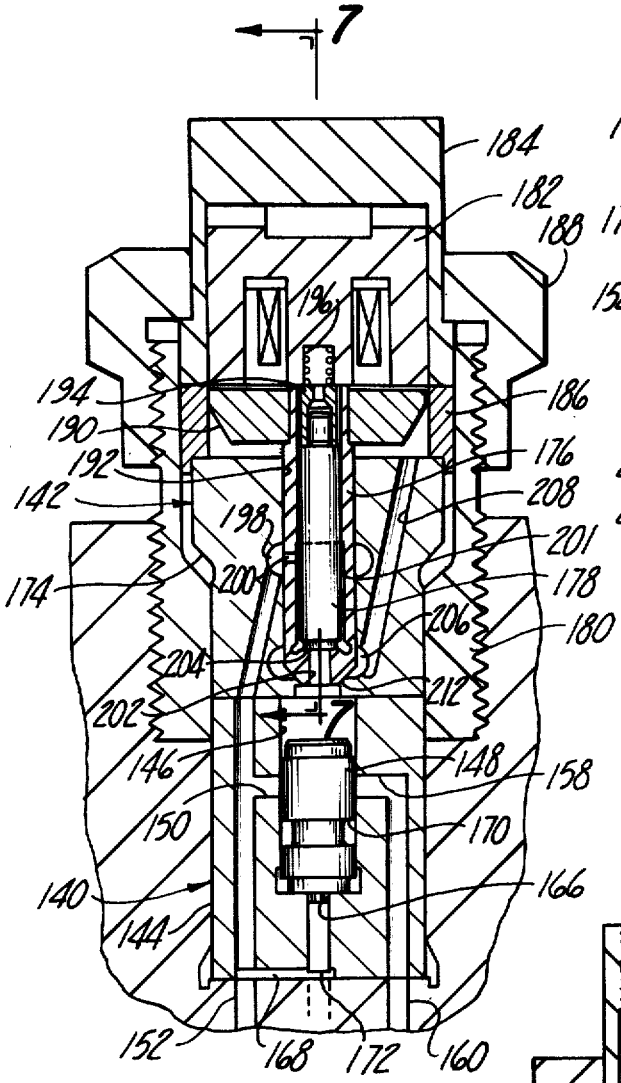
FIG. 6 is an enlarged sectional view taken on lines 6—6 of FIG. 3.
Figure 7:
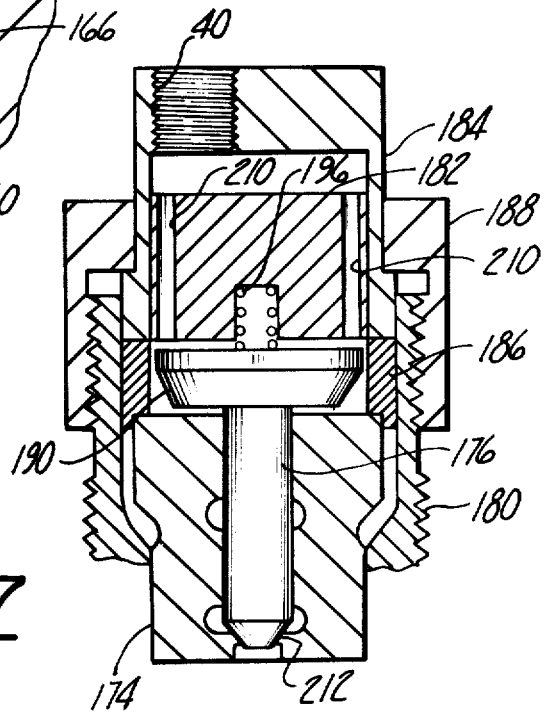
FIG. 7 is a sectional view taken on lines 7—7 of FIG. 6.

The timing valve means 80 is provided to energize the pump 78 and thus initiate injection of fuel into the cylinder at a predetermined time in the engine cycle. The timing valve means 80, as shown in FIGS. 2, 6 and 7, comprises a spool or shuttle valve 140 and an electromagnetic pilot or solenoid valve 142. In general, the timing means 80 is adapted to energize the pump 78 by admitting pressurized fluid thereto, namely fuel from the supply passage 85, in response to an electrical timing signal which energizes the solenoid valve 142. As will be understood, the combination of the solenoid valve and the shuttle valve is used in order to achieve fast response and sufficient power amplification to actuate the pump.

The shuttle valve 140 comprises a valve body 144 which defines a cylinder 146 which receives a valve element or spool valve 148. The shuttle valve body 144 has an inlet port 150 which is connected through an axial passage 152 (extending through body 144 and body member 84) to a transverse passage 154 which intercepts the fuel supply passage 85. The transverse passage 154 is closed at the front face of the lower portion of body member 84 by a plug 156. The valve body 144 defines an outlet port 158 which is connected through an axial passage 160 which extends through a transverse passage 161 to an axial passage 162 and thence to the actuating chamber 92. The passage 161 is closed by a plug 164 in the face of the body member 84.

The cylinder 146 in the valve body 144 includes a lower cylinder portion 166 (see FIG. 6) of reduced diameter which opens into a transverse passage 168 which is in communication with the fuel supply passage 152. The spool valve 148 defines an annular groove 170 and includes a stem 172 which extends into the lower cylinder portion 166. Fuel pressure thus acts on the reduced area of the stem 172 and tends to urge the spool valve in a direction to align the annular groove 170 with the inlet and outlet ports 150 and 158 to open the valve. A drain passage 171 extends from the lower end of the cylinder 146 to the transverse drain passage 88 to remove any fluid which leaks past the spool valve. The drain passage 88 is connected through passage 86 with the drain outlet 36 and is closed at its outer end by a plug 173. The operation of the shuttle valve 140 is controlled by the solenoid valve 142 in a manner that will now be described.

The solenoid valve 142, as shown in FIGS. 6 and 7, is a 3-way valve in that it is provided with three ports and may be operated so that one port communicates exclusively with either of the other two. The solenoid valve 142 comprises a valve body 174 defining a cylinder 192, a first valve element or sleeve valve 176 slidably disposed within cylinder 192, and a second valve element or post valve 178 which is slidable relative to the sleeve. The valve body 174 is disposed in alignment with the valve body 144 of the shuttle valve 140 and is mounted in an adaptor 180 which is threadedly engaged with the upper portion of the body member 84. The solenoid valve further comprises an electromagnet 182, in the form of an E-core and coil, which is potted inside a cover member 184. The electromagnet 182 is separated from the valve body 174 by a nonmagnetic spacer ring 186 and a flange nut 188 engages the cover 184 and is threadedly secured to the adaptor 180. The solenoid valve 142 further comprises an armature 190 of magnetic material disposed in the space between the electromagnet 182 and the valve body 174. The armature 190 is of annular configuration and is secured, as by a press fit, to the upper end of the valve sleeve 176. The valve sleeve 176 is movable to an upper position when the electromagnet is energized and to a lower position when it is de-energized, as explained below. The valve post 178 is slidably disposed within the sleeve 176 and is provided with a spacer 194 of nonmagnetic material at its upper end. The spacer is secured on a reduced portion of the post, as by press fitting, and engages a bias spring 196 which is seated in a recess of the E-core 182.

The valve port arrangement of the solenoid valve 142 is as follows. The valve body 174 defines a pressure inlet port 198 which communicates with the fuel supply passage 152. The sleeve valve 176 is provided with a port 200 which communicates with the port 198. The sleeve valve 176 has an enlarged inside diameter below the port 200 to provide an annular chamber 201 which opens into a lower port 202 at the end of the sleeve valve. The port 202 opens into the cylinder 146 of the shuttle valve body 144. The lower end of the post valve 178 is adapted to close against a valve seat 204 on the sleeve valve 176 and prevents communication between the pressure inlet port 198 and the port 202 when the sleeve valve 176 is in its upper position. An exhaust port 206 is provided in the valve body 174 at the lower end of the cylinder 192. This port communicates through a passage 208 to the space surrounding the armature 190 and thence through passage 210 in the E-core potting to the second drain outlet 40. In order to provide for opening and closing of the exhaust port 206, the valve body 174 is provided with a valve seat 212 which coacts with the lower end of the sleeve valve 192. When the electromagnet 182 is de-energized the sleeve valve 192 is closed and the post valve 178 is opened at seat 204 by the action of the fluid pressure in the annular chamber 201; when the electromagnet is energized the sleeve valve 192 is opened at seat 212 and the post valve 178 is closed at seat 204.

In summary, the solenoid valve 142 functions as follows. When the electromagnet 182 is de-energized, the sleeve valve 176 is in its lower position. This closes the sleeve valve against the valve seat 212 and it opens the post valve 178 at the valve seat 204. This provides communication between the pressure inlet port 198 through port 200 in the sleeve valve to the port 202, thus admitting pressure to the upper end of the spool valve 148. (In this condition the fluid pressure on the lower end of the valve post 178 is sufficient to overcome the force of the bias spring 196 and the valve post is seated against the face of the E-core.) When the electromagnet 182 is energized the armature 190 holds the sleeve valve 192 in its upper position. In this condition the post valve 178 is seated against the valve seat 204, thus closing communication between the pressure inlet port 198 and the port 202. Also, in this condition, with the sleeve valve 192 in its upper position, the sleeve valve is lifted off the valve seat 212 and the upper end of the cylinder 146 is connected with the exhaust port 206.

The solenoid valve 142 controls the shuttle valve 140 in the following manner. When the electromagnet 182 is de-energized, the sleeve valve 192 is in its lower position and the pressure inlet port 198 is connected with the port 202 and fuel under pressure is admitted to the upper end of valve cylinder 146. As noted above, fuel under pressure is always acting on the valve stem 172. Because of the differential area of the valve stem 172 and the upper end of the spool valve 148, the spool valve is moved to its lower position. This disconnects the inlet port 150 from the outlet port 158. When the electromagnet 182 is energized, the sleeve valve 176 is moved to its upper position and the post valve 178 closes against the valve seat 204 and cuts off the fuel supply pressure to cylinder 146. At the same time, the sleeve valve is lifted from the valve seat 212 and the cylinder 146 is connected with the exhaust port 206 and the fuel pressure in cylinder 146 is relieved. Consequently, the spool valve 148 is moved to its upper position by the fuel supply pressure acting on the valve stem 172. This connects the pressure inlet port 150 with the outlet port 158 and fuel supply pressure is applied through the passages 160, 161 and 162 to the actuator chamber 92. In summary, the shuttle valve 140 is opened by energizing the solenoid valve 142 and pressure is admitted to the actuator chamber 92 of injector pump 78. When the solenoid valve 142 is de-energized the shuttle valve 140 is closed and the fuel supply pressure is cut off from the actuator chamber 92.

The Metering Valve Means

The metering valve means 82, as stated above, performs the function of controlling the quantity of fuel to be injected into the cylinder for each engine cycle. As will appear more fully below, this is accomplished by controlling the return stroke of the injector pump 78 to set the injector chamber 128 for a predetermined volume.

Figure 8:
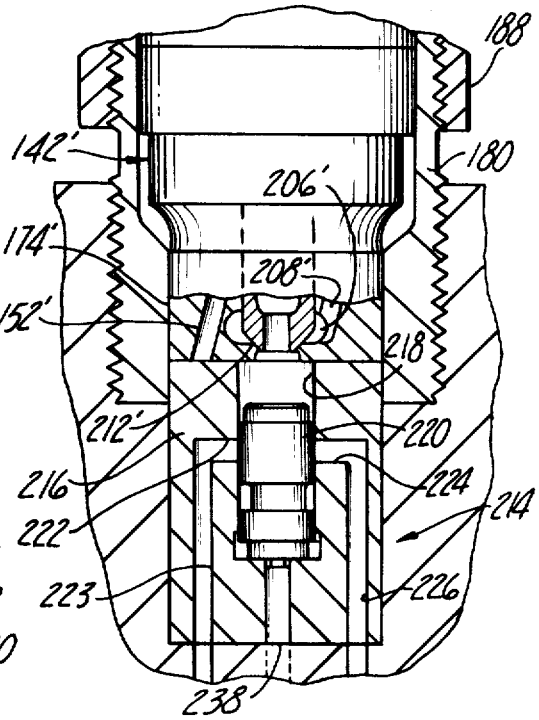
FIG. 8 is a fragmentary view showing details of construction.

The metering valve means 82, as shown in FIGS. 2 and 8, is similar in construction to the timing valve means 80; in fact, the solenoid valve 142' is identical to the solenoid valve 142. Accordingly, those parts in the metering valve means 82 which are identical to parts in the timing valve means 80 are given reference characters of the same number but with a prime symbol. In view of this similarity, description of the solenoid valve 142' and its mounting structure is omitted.

The metering valve means 82 comprises, in addition to the solenoid valve 142', a spool or shuttle valve 214. The shuttle valve 214 comprises a valve body 216 which defines a cylinder 218 which receives a spool valve 220. The valve body 216 defines an inlet port 222 which communicates through a passage 223 and thence through passages 161 and 162 with the actuator chamber 92. The valve body 216 also defines an outlet port 224 which is connected through an axial passage 226 to a transverse drain passage 86 which is connected with the drain outlet 36 (in body member 84, see FIG. 3). A drain passage 234 extends from the lower portion of cylinder 218 to the transverse drain passage 88 to drain any fluid which leaks past the valve spool.

The spool valve 220 is provided with a stem 238 which extends through a reduced portion of the cylinder 218 to the lower end of the valve body. A transverse passage 240 (see FIG. 3) extends from the fuel supply passage 152' to the lower end of the reduced cylinder portion. The fuel supply passage 152' and transverse passage 240 deliver fuel supply pressure to the stem 238 to urge the spool valve 220 toward its upper position.

When the solenoid valve 142' is de-energized, fuel supply pressure is applied through the solenoid valve to the cylinder 218. Since the upper face of the spool valve 220 is of larger area than the face of the stem 238, the spool valve is in its lower position when the solenoid valve is de-energized. In this position the spool valve 220 closes the inlet port 222 and the outlet port 224. With the shuttle valve closed, the line 224 is closed so that there is no release of fluid supply pressure in actuator chamber 92. When the solenoid valve 142' is energized the shuttle valve 214 is opened and the fuel supply pressure in the actuator chamber 92 is relieved by connection to the drain through passages 162, 161 and 223, ports 222 and 86 and passages 226 and 86. The sequencing of the metering valve means 82 in relation to that of the timing valve means 80 will be described below.

Operation

The operation of the injector of this invention will now be described with particular reference to FIGS. 1, 2, 4 and 9. The fuel supply at regulated pressure is admitted to the injector at the inlet port 24. The fuel is supplied to the metering chamber 94 through the fuel supply passage 85, the orifice of calibrating needle 124, passage 122 and thence through the check valve 126 and passage 128. For explanatory purposes, it will be assumed that the injector is in a state of readiness for initiating an injection cycle. In this condition, both the timing solenoid 142 and the metering solenoid 142' are de-energized and the shuttle valves 140 and 214 are closed. Accordingly, the pump piston 95 is urged by the fuel supply pressure in the metering chamber 94 to a position determined by the quantity of fluid trapped in the actuator chamber 92 by the closure of the shuttle valves. (This condition will be more fully described below in connection with the injection cycle.) In this state of readiness for injection, fuel under regulated pressure thus fills the metering chamber 94 and also fills the supply passages to the nozzle 76. The nozzle supply passages include passages 130, 132, 134 and the annular chamber 108 at the needle valve 110, as shown in FIGS. 2 and 4. The regulated fuel supply pressure in the annular chamber 108 is insufficient to lift the needle valve 110 off its seat against the bias force of the spring 114. Accordingly, the needle valve remains closed and the injector nozzle is inactive but in a state of readiness for fuel injection.

Figure 9:
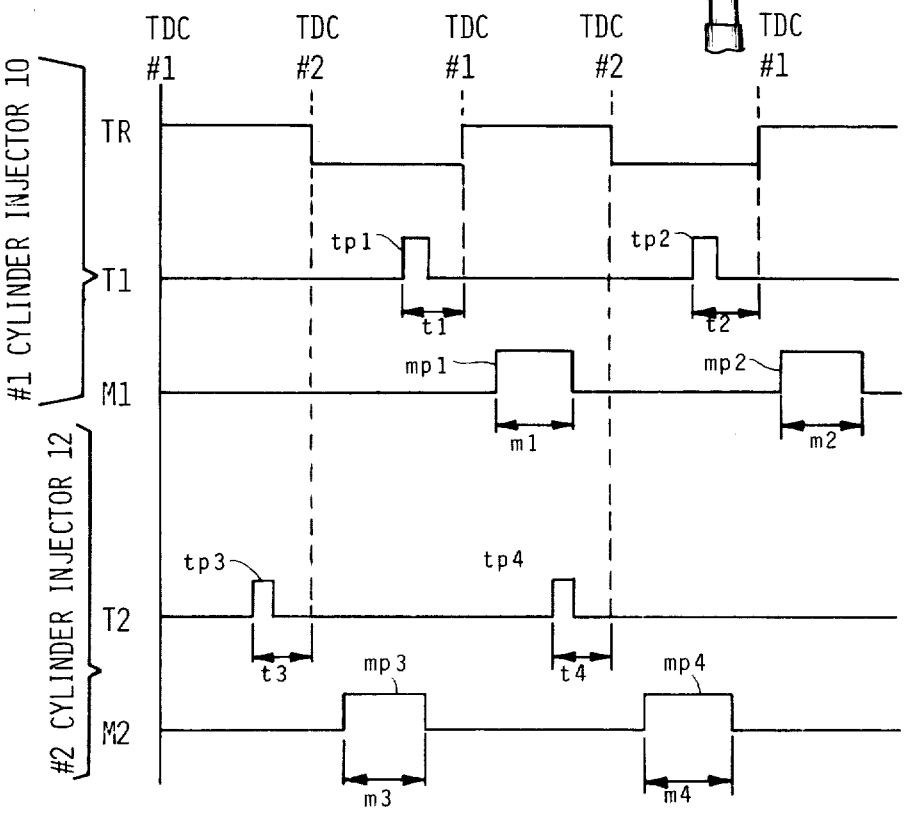
FIG. 9 is a timing diagram for use in explaining the operation of the injector of this invention.

In order to control the set of injectors of an engine in timed relation with engine operation, electrical control signals from the electronic control unit 54 are applied to the respective injectors. This will be described with reference to FIGS. 1 and 9 which represent the injector operation in a 2-cylinder engine. The trigger signal TR which is supplied to the electronic control unit 54 is generated in synchronism with engine rotation and one cycle of the trigger signal corresponds to one revolution of the engine. As shown in FIG. 9, during the first one-half revolution of the engine crankshaft, from top dead center (TDC) in cylinder #1 to TDC in cylinder #2, the trigger signal is high and during the second one-half revolution the trigger signal is low. The control signals to be described are generated by the control unit 54 so that injector 10 of cylinder #1 produces a timed fuel injection during the second one-half revolution and the injector 12 of cylinder #2 produces timed fuel injection during the first one-half crankshaft revolution.

The electronic control unit 54 produces, for the injector 10 of cylinder #1, a timing signal T1 which includes timing pulses tp1, tp2, etc. which are of a fixed time duration or pulse width. The timing pulses are produced by the control unit 54 at a variable injection advance angle or timing before top dead center. In the example of FIG. 9, the timing pulse tp1 occurs at a time t1 before top dead center, and the timing pulse tp2 occurs at a time t2 before top dead center. It is noted that the timing pulses tp1 and tp2 occur with their leading edges at an injection advance angle which varies from one engine cycle to the next according to the computation of the optimum injection advance for the subsisting engine conditions. The control unit 54 also produces, for the injector 10 of cylinder #1, a metering signal M1 which includes metering pulses mp1, mp2, etc. which are of variable time duration or pulse width. Each metering pulse is initated after the termination of the immediately preceding timing pulse and the time duration thereof varies from one cycle to the next in accordance with the computed value of fuel quantity to be injected to obtain optimum engine performance under the subsisting operating conditions. The timing pulses have a typical time duration of about one millisecond whereas the metering pulses have a typical value in the range of several milliseconds. The time duration of timing pulses, as mentioned above, is suitably of constant value and must be at least as long as the time required for the pump piston of the injector to execute a forward stroke. Each metering pulse may be initiated at any time in the engine cycle provided that it does not overlap the preceding timing pulse or the succeeding timing pulse. Similarly, in the example of FIG. 9, the timing signal T2 comprises timing pulses tp3, tp4, etc. which are of fixed time duration and which occur at times t3 and t4, respectively, before top dead center for cylinder #2. Also, for cylinder #2, the control unit produces metering signal M2 including metering pulses mp3, mp4, etc. having time durations of m3 and m4, respectively.

With injector 10 in readiness for an injection cycle, as described above, the timing pulse tp1 is applied to the timing solenoid 142. This causes the shuttle valve 140 to open and fuel is admitted at regulated supply pressure to the actuator chamber 92 of the pump piston 95. This energizes the actuator piston 96 and the injector piston 98 executes a forward stroke into the metering chamber 94. The forward stroke of the injector piston 98 extends from its initial or rest position to a fixed stop position in which the forward end of the actuator piston 96 seats against a lower wall of the annular chamber 100. This forward stroke of the injector piston 98 produces high fluid pressure in the metering chamber 94 which exceeds the regulated fuel pressure in accordance with the amplification produced by the pump piston. Thus, the check valve 126 is closed and the pressure in the metering chamber and in the nozzle passages 130, 132, 134 and the annular chamber 108 exceeds the injection pressure and lifts the needle valve 110 off its valve seat 112. Accordingly, injection occurs through the nozzle body 106 and the spray tip 120. At the end of the forward stroke of the pump piston the needle valve 110 closes and the injection is ended. At the end of the timing pulse tp1, the solenoid 142 is de-energized and the shuttle valve 140 is closed. As a result, the supply of fuel under pressure is removed from the actuator chamber 92 but the actuating fluid in the chamber is trapped by the closure of the shuttle valve 140 and the pump piston 95 remains in position at the forward end of its stroke. When the metering pulse mp1 occurs, the metering solenoid 142' is energized and the shuttle valve 214 is opened. This allows the fluid trapped in the actuating chamber 92 to be exhausted through the passages 162, 161, 223, to the inlet of the shuttle valve and thence through the outlet 224 of the valve and the passage 226 to the exhaust port 36. As a result, the pump piston 95 is moved in its return stroke by the pressure of the fuel in the metering chamber 94. The rate of movement of the piston in its return stroke is governed by the rate of fuel flow into the metering chamber which is adjustably set by the calibrating needle 124. The pump piston 95 including the injector piston 98 and actuator piston 96 continue to move in the return stroke until the shuttle valve 214 is closed (or until the piston reaches its full return position.) When the metering pulse mp1 is terminated the solenoid valve 142 is de-energized and the shuttle valve 214 is closed. When the shuttle valve 214 is closed, the fluid in the actuating chamber 92 is trapped and the motion of the piston is arrested. Thus the injector piston 98 is held in a predetermined position, according to the time duration of the metering pulse, to set the volume of the metering chamber and the quantity of the fuel to be injected on the next injection cycle.

It will be appreciated that the operation of the injector 12 in cylinder #2 is similar to that just described for injector 10. In each injector, the timing solenoid is energized at a predetermined time in the engine cycle, and after injection has occurred, the metering solenoid is independently energized for a predetermined time period to establish the quantity of fuel injection for the next injection cycle. This energization is repeated during each engine cycle.

Although the description of this invention has been given with reference to a particular embodiment it is not to be construed in a limiting sense. Many variations and modifications will now occur to those skilled in the art. For a definition of the invention, reference is made to the appended claims.

What is claimed is:

1. A fuel injector for an internal combustion engine, the engine being provided with a fuel supply source and a drain with the source at higher pressure than the drain, the injector comprising:

an injector body member including a first fluid passage adapted to be in fluid communication with said source and a second fluid passage adapted to be in communication with said drain, an injector nozzle, a fuel metering chamber in communication with the nozzle and in communication with the first passage, an injector piston in the metering chamber and being movable to expel fuel therefrom to the nozzle, an actuator chamber, an actuator piston in the actuator chamber and being movable in response to fluid pressure in the actuator chamber, said injector piston being connected with the actuator piston and movable therewith, a timing valve having an inlet adapted to be in communication with a source of actuator fluid under pressure and having an outlet in communication with said actuator chamber, a metering valve having an inlet in communication with said actuator chamber and an outlet adapted to be in communication with an actuator fluid drain, and control means for said timing and metering valves for independent actuation thereof whereby opening said metering valve for a pedetermined time period while the timing valve is closed causes the injector piston to move outwardly of the metering chamber to provide a predetermined volume of fuel in the metering chamber and opening of the timing valve while the metering valve is closed causes the actuator piston to actuate the injector piston and expel fuel from the metering chamber to the nozzle.

2. The invention as defined in claim 1 wherein said control means comprises a first electrically energized actuator operatively connected with said timing valve and adapted to receive a control signal, and a second electrically energized actuator operatively connected with said metering valve and adapted to receive a second control signal.

3. The invention as defined in claim 1 wherein said injector nozzle includes valve means which is opened in response to a predetermined pressure value which is higher than the pressure of said fuel supply source, the admission of actuator fluid under pressure to said actuator chamber being effective to cause the actuator piston to produce the pressure in the metering chamber in excess of said predetermined value of pressure.

4. The invention as defined in claim 3, wherein the inlet of said timing valve is in communication with the first fluid passage and the outlet of said metering valve is in communication with said second fluid passage, thereby utilizing the fuel supply source and drain for the actuator fluid.

5. The invention as defined in claim 4, wherein said actuator piston has a larger cross-sectional area than the injector piston whereby the pressure in said metering chamber is greater than the pressure in the actuator chamber.

6. The invention as defined in claim 5 including a check valve disposed between said metering chamber and said first passage to prevent flow from said metering chamber to said first passage.

7. The invention as defined in claim 6 wherein said timing valve comprises a first spool valve having a first cylinder defining the inlet and outlet of the timing valve and a first piston movable therein for opening and closing the timing valve, biasing means urging said first piston to a normally closed position, said first electrically energized actuator being operatively connected with said first piston for opening said timing valve when said actuator is energized.

8. The invention as defined in claim 7 wherein said metering valve comprises a second spool valve having a second cylinder defining the inlet and outlet of the metering valve and a second piston movable therein for opening and closing the metering valve, biasing means urging said second piston to a normally closed position, said second electrically energized actuator being operatively connected with said second piston for opening said metering valve when said second electrically energized actuator is energized.

9. The invention as defined in claim 8 wherein said biasing means for said first piston comprises means providing communication of said first passage with both ends of said first piston, one end having a larger cross-sectional area than the other, whereby the fluid pressure of said fuel urges said first piston toward the closed position.

10. The invention as defined in claim 8 wherein said biasing means for said second piston comprises means providing communication of said first passage with both ends of said second piston, one end having a larger cross-sectional area than the other, whereby the fluid pressure of said fuel urges said second piston toward the closed position.

11. The invention as defined in claim 10 wherein said first electrically energized actuator comprises a three-way pilot valve having first, second and third ports, the first port being in communication with said first passage, the second port being in communication with the larger end of the first piston of the timing valve and the third port being in communication with said second passage, an electromagnet connected with said pilot valve, said pilot valve being open from said first port to said second port and closed from said second port to said third port when the electromagnet is deenergized, and said pilot valve being open from said second port to said third port and being closed from said first port to said second port when the electromagnet is energized.

12. The invention as defined in claim 10 wherein said second electrically energized actuator comprises a three-way pilot valve having first, second and third ports, the first port being in communication with said first passage, the second port being in communication with the larger end of the second piston of the metering valve and the third port being in communication with said second passage, an electromagnet connected with said pilot valve, said pilot valve being open from said first port to said second port and closed from said second port to said third port when the electromagnet is deenergized, and said pilot valve being open from said second port to said third port and being closed from said first port to said second port when the electromagnet is energized.

13. In a fuel injector, an injector pump including a metering chamber and an actuator chamber, a pump piston including an actuator portion movable in said actuator chamber and an injector portion movable in said metering chamber, means for constantly supplying fuel under pressure to said metering chamber, an injector nozzle in fluid communication with said metering chamber, first control mean including a first valve in direct fluid communication with said actuator chamber for supplying fluid under pressure to the actuator chamber over a first time interval having a variable time of initiation, and a second control means including a second valve in direct fluid communication with said actuator chamber for exhausting said actuator chamber over a second time interval having a variable time duration, said first and second valves being movable independently of each other.

14. The invention as defined in claim 13 wherein said first valve is a shuttle valve, a first electromagnetically actuated valve connected with the first valve said second valve is a shuttle valve, and a second electromagnetically actuated valve connected with the second valve.

15. The invention as defined in claim 14 wherein each of said electromagnetically actuated valves comprises, a three-way pilot valve, an electromagnet connected with said pilot valve for actuation thereof, the respective shuttle valve being in fluid communication with said pilot valve for actuation by the pilot valve, and said respective shuttle valve being in fluid communication with said actuator chamber.

* * * * *